United States Patent [19]

Balash

[11] 4,323,740

[45] Apr. 6, 1982

[54] KEYBOARD ACTUATOR DEVICE AND KEYBOARD INCORPORATING THE DEVICE

[75] Inventor: Frederick A. Balash, Mesa, Ariz.

[73] Assignee: Rogers Corporation, Rogers, Conn.

[21] Appl. No.: 118,513

[22] Filed: Feb. 4, 1980

[51] Int. Cl.[3] ..... H01H 13/70

[52] U.S. Cl. ..... 200/5 A; 200/159 B; 200/329

[58] Field of Search ..... 200/5 R, 5 A, 159 B, 200/329, 340, 302

[56] References Cited

U.S. PATENT DOCUMENTS

| | | | |
|---|---|---|---|
| 3,909,564 | 8/1975 | Scheingold et al. | 200/159 B X |
| 3,982,081 | 9/1976 | Demler, Jr. | 200/159 B X |
| 4,032,729 | 6/1977 | Koistinen | 200/5 A |
| 4,190,748 | 2/1980 | Langford | 200/5 A |

*Primary Examiner*—James R. Scott

*Attorney, Agent, or Firm*—Fishman and Van Kirk

[57] ABSTRACT

An activation device is presented for a tactile keyboard of the type having a molded monolithic plastic layer of tactile elements. The actuator is a thermocompressively molded monolithic plastic layer which incorporates a matrix of geometrically designed strikers, the actuator layer being interposed between the keys and the molded monolithic plastic layer of tactile elements in a keyboard assembly.

10 Claims, 2 Drawing Figures

KEYBOARD ACTUATOR DEVICE AND KEYBOARD INCORPORATING THE DEVICE

BACKGROUND OF THE INVENTION

One type of snap-action or tactile feedback keyboard currently in widespread use involves the use of a contoured element which performs both the snap-action or tactile feedback function and also effects electrical contact when the keyboard is actuated. The snap-action or tactile element may be either a contoured metal element or a contoured plastic element in a keyboard assembly. In the case of the metal elements, they are typically formed out of spring metal, and they may be formed as individual contoured discs or as a strip of contoured discs or curved metal strips. In the case of plastic snap-action elements, they are typically formed by thermocompressive molding of a monolithic plastic layer (such as Mylar polyester) which is formed to include a matrix of contoured tactile elements. In almost all cases, the tactile elements are enclosed in a molded plastic case. While some keyboard configurations are actuated by direct application of the actuating force (typically the finger of the keyboard user) to the contoured tactile element, many keyboard configurations have discrete keys in the keyboard case to which the actuating force is applied and through which the actuating force is delivered to activate the tactile element. The keys are typically molded plastic elements, and they may be of various constructions known in the art, such as living hinge keys, floating hinge keys and full floating keys.

Experience in the keyboard industry has shown that it is often desirable to have a striker of a specifically determined configuration on the bottom of the key to come into contact with the tactile element for actuating the tactile element. The particular shape and location of the striker is often important in achieving optimum or even satisfactory operation of the tactile element. Thus, for example, in some keyboards using metal discs, the striker on the bottom of the key is a hemispherical element which applied a point contact force to the contoured tactile element. Similarly, for some constructions using the plastic snap-action elements, the striker on the bottom of the key may be in the form of a bar to deliver a line of actuating force to the tactile element.

Heretofore, it has not generally been possible to obtain a high degree of interchangeability between keyboard components. For example, when a manufacturer has been using a keyboard with plastic case and keys and a metal dome, and the manufacturer decides he wants to use the same case and keys with tactile elements in the molded plastic sheet, he encounters the problem that the striker on the key for the metal element will not be suitable for the plastic tactile element. Therefore, the key must be redesigned, new molds may be required, and substantial additional expenses may be encountered. Also, if the manufacturer is going to use both types of tactile elements in different keyboard applications, then the manufacturer is faced with duplication or multiplication of requirements for tooling, inventory control and quality control.

SUMMARY OF THE INVENTION

The several problems discussed above are eliminated or substantially alleviated by the present invention. In accordance with the present invention, a thermocompressively molded monolithic plastic striker layer is incorporated in the keyboard assembly between the discrete individual plastic keys and the layer of formed plastic tactile elements. The striker layer has a plurality of individual and separately actuatable striker elements at locations corresponding to the locations of the formed tactile keyboard elements. These striker elements are formed to have the appropriate geometry required for the striker bar required for the particular tactile element in the keyboard assembly. The striker bar on the key (which can now remain unchanged from whatever original configuration it may have had) or the key itself if there is no striker bar will engage the striker element which, in turn, contacts the tactile element to provide the necessary force distribution to promptly actuate the tactile element. The striker layer thus becomes an intermediate layer with striker elements which transmit the force from a key to the plastic tactile element with proper force distribution required by the tactile element, even though the key does not have a properly formed striker bar.

The important feature and advantage of the striker layer and its individual striker elements is that the striker surface of the plastic key can have a wide range of geometries and yet still provide the requisite force to the striker layer which in turn will actuate the tactile elements. This leads to further important advantages of versatility and freedom of design in keyboards of the plastic tactile element type. More specifically, the geometries of tactile elements in a keyboard configuration can be changed without requiring a change in key design. All that is required in any of these cases is to incorporate in the keyboard configuration the intermediate striker layer with appropriately shaped striker elements to receive the actuating force from the key and deliver the actuating force to the plastic tactile elements.

Accordingly, one object of the present invention is to provide a novel and improved keyboard actuator device and keyboard incorporating the actuator device.

Still another object of the present invention is to provide a novel and improved keyboard actuator device and keyboard for keyboards of the type incorporating thermocompressively molded monolithic plastic layers of tactile elements.

Still another object of the present invention is to provide a novel and improved keyboard actuator device and keyboard wherein an actuator layer is interposed between discrete keys and plastic tactile elements to deliver appropriate actuating forces to the tactile elements regardless of the striker configurations of the keys.

Other objects and advantages will be apparent to and understood by those skilled in the art from the following drawings and detailed description.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
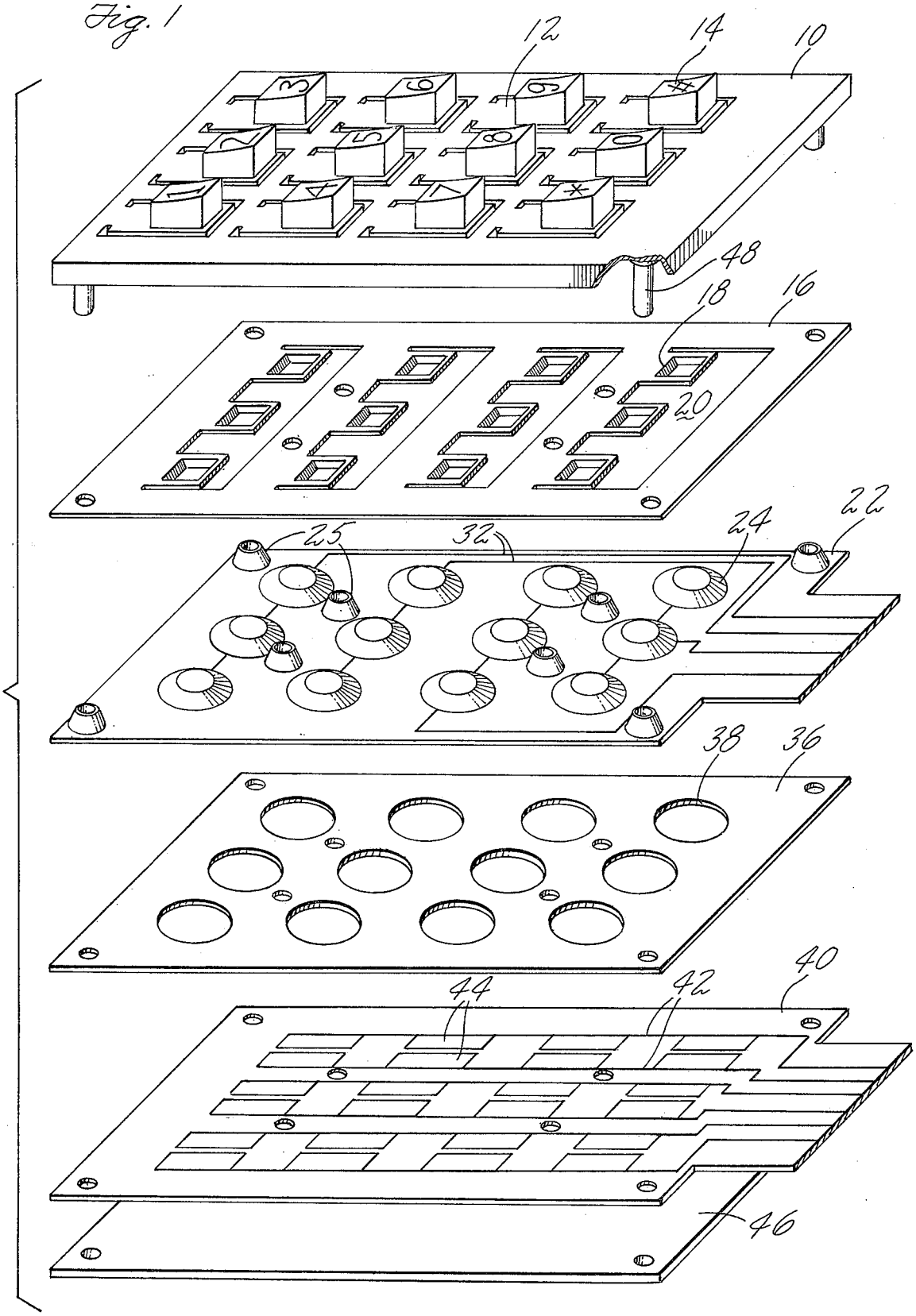
FIG. 1 is an exploded perspective view of a keyboard and keyboard actuator in accordance with the present invention.
Figure 2:
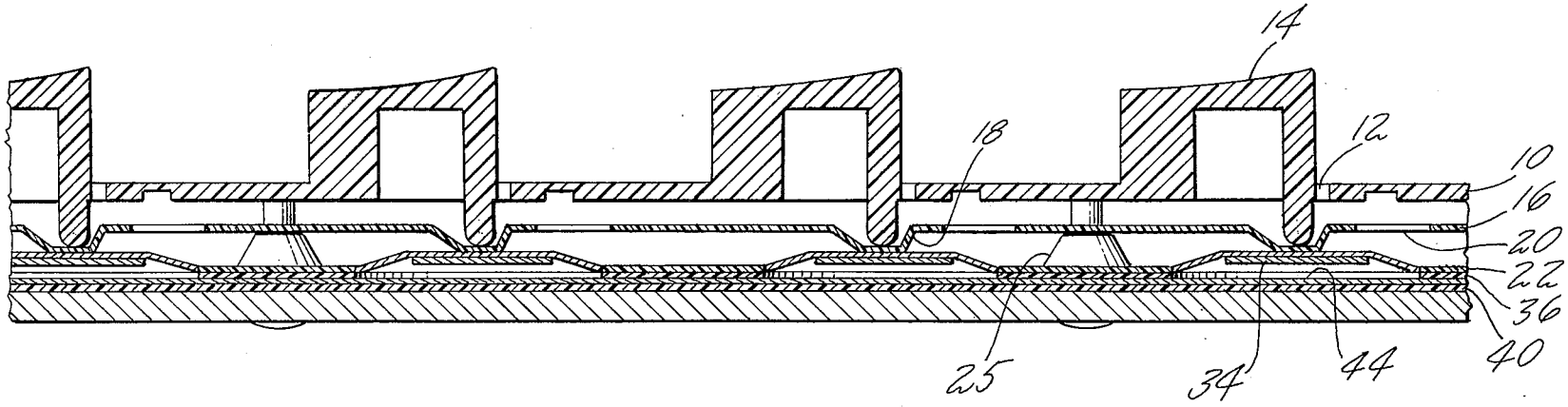
FIG. 2 is an enlarged partial cross sectional view of a detail of a part of an assembled keyboard.

Referring simultaneously to FIGS. 1 and 2, a keyboard is shown having a plastic upper case 10. Upper case 10 has a plurality of openings or windows with discrete keys 14 positioned in each of the windows. The keys 14 are illustrated to be of the living hinge type, but it will be understood that other key configurations, such as floating hinge and full floating keys may also be used. Each key has a striker 15 on the bottom of the key.

Directly beneath the upper case 10 there is located a striker layer 16 in the form of a thermocompressively molded monolithic plastic layer, preferably of Mylar polyester. Striker layer 16 has a plurality of individual striker elements 18 having a contoured recess to be engaged by the bottom of key 14 or key striker 15, striker elements 18 being integrally formed in the striker layer and being formed of the appropriate geometric shape to serve as the required striker element for proper delivery of actuation force to a plastic tactile element in the keyboard. The striker elements 18 are integrally formed in sheets 16 with a living hinge construction, and there is one striker element 18 corresponding to and aligned with each key 14. The specific configuration or striker layer shown in the drawings has openings or windows 20, each of which contains three of the striker elements 18. However, it will be understood that the striker layer could also be shaped with individual windows for each of the striker elements.

The next layer in the keyboard assembly is a thermocompressively molded monolithic plastic tactile element sheet 22 having a plurality of tactile element protrusions 24 formed in the sheet. The tactile element protrusions 24 are in the form of truncated cones, each of which has an annular inclined side surface and a flat top surface. A conductive pattern of copper, silver ink or other conductive material is adhered to the underside of sheet 22, with the circuit patterns ending in contact pads 34 on the underside of the flat portion 30 of the tactile element. For a more detailed description of the tactile element sheet 22 and the truncated cone tactile element protrusions formed therein, reference is made to United State Patent Application Ser. No. 763,925, U.S. Pat. No. 4,190,748 assigned to the assignee of the present invention. The assembly includes a number of individual tactile element protrusions 24 corresponding to the number of keys 14 and striker elements 18, the keys, striker elements and protrusions being in predetermined alignment. Sheet 22 also has spacer protrusions 25 to space sheet 16 relative to sheet 22.

The next layer in the keyboard assembly is a plastic spacer 36 having openings or windows 38 aligned with each of the tactile elements to permit the contact pads 34 to move downwardly through the windows to contact circuit elements on a lower circuit board when the keyboard is actuated. Spacer 36 may also be a Mylar polyester sheet. Alternately, spacer 36 may be a resilient foam material having good compression set characteristics (i.e., being resilient to compressions set) such as disclosed and described in U.S. Patent Application Ser. No. 034,001 which is assigned to the assignne hereof and which is incorporated herein by reference.

The next layer in the keyboard assembly is a lower flexible printed circuit sheet 40 with circuit pattern 42 thereon including contact pads 44. The contact pads 44 are aligned with the contact pads 34 of tactile element sheet 22, whereby circuits are closed and signals are created by the keyboard when the tactile elements are actuated. The lower most layer of the assembly is a rigid backer or stiffener board 46 of any desired rigid plastic material. The assembly is held together by plastic stakes 48 which are formed integrally with upper plastic case 10 and extend through holes in protrusions 25 and appropriately placed holes in each of the other layers of the assembly and are flattened by application of heat in known fashion, to mark the layers of assembly together.

As was previously discussed, the striker 15 on the bottom surface of a key is often of specific geometric configuration determined by the type and shape of tactile element to be actuated. Since different tactile elements often have specific requirements for striker configurations in order to impose the proper load distribution for actuating the tactile element, key striker configurations are usually specifically tailored for the particular tactile element of a keyboard, and it is not practicable to take a given key with a particular striker design and use it with another tactile element.

In accordance with the present invention, the geometric configuration of the striker 15 on the bottom of key 14 becomes a noncritical element. The geometric configuration of striker 15 may take on any typical shape, or may be omitted entirely, since in the present invention it serves only as a force transmitter to deliver the actuating force to the individual molded plastic striker elements 18 of striker layer 16. Key striker 15 projects into the recess or pocket 19 and engages the upper surface of each element 18. The individual molded plastic striker elements 18 are formed with the geometric shape required for the particular tactile element in the keyboard array. Thus, for example, with the flat top truncated cone configuration illustrated herein, the individual plastic striker elements 18 are formed with the bottom surface in the shape of an elongated bar to deliver the actuating force to flat top 30 along a line of force to properly activate the tactile element to bring conductive pad 34 into contact with conductive pad 40 with an accompanying snap-action or tactile feedback from the tactile element.

As has been indicated above, if it is desired to replace tactile element sheet 22 with a tactile element sheet of another tactile configuration, (whether of different size, shape or material) the existing key top can still be used. All that is required to be done is to replace the striker layer 16 with another molded plastic striker layer with striker elements of the shape required to activate the different tactile elements to be incorporated in the keyboard. Thus, the existing key top and keys can be used in the new keyboard configuration, thereby avoiding the significant expense heretofore encountered in having to change or redesign the entire key top. Furthermore, a keyboard user can now switch from metal tactile elements to plastic tactile elements, and vice versa, merely by incorporating the appropriate striker layer and appropriately formed striker elements. This versatility has not been available in the industry heretofore.

While preferred embodiments have been shown and described, various modifications and substitutions may be made thereto without departing from the spirit and scope of the invention. Accordingly, it will be understood that the present invention has been described by way of illustration and not limitation.

What is claimed is:

1. A switch assembly including:

a first circuit layer having a first electrical circuit element on at least one surface thereof, said first circuit layer defining a first plane;

a second circuit layer having a second electrical circuit element on at least one surface thereof, said second circuit layer defining a second plane, said second circuit layer being positioned relative to said first circuit layer so that said second element is facing but normally out of contact with said first circuit element and said first and second planes are substantially parallel to one another;

a tactile protrusion formed in said second circuit layer, said tactile protrusion projecting out of said first plane and away from said first circuit layer, said tactile protrusion supporting at least a portion of said second electrical circuit element for selective contact with said first electrical circuit element;

a key spaced from said second circuit layer on the side thereof removed from said first circuit layer, said key including a movable actuator bar positioned to cause actuation of said tactile protrusion, said actuator bar being in registration with at least a part of said protrusion; and a striker element positioned between said key and said tactile protrusion to effect electrical contact between said first and second circuit elements with tactile feedback, said striker element being generally planar and parallel to said first and second circuit layers, said striker element being provided with a recess which extends away from said key, said recess receiving said key actuator bar and having a geometrical configuration which will transmit an actuating force from said key to the protrusion.

2. A switch assembly as in claim 1 further including:

insulating means between said first and second circuit layers, said insulating means having an opening aligned with said protrusion to permit selective contact between said first and second circuit elements.

3. A switch assembly as in claim 1 wherein:

said second circuit layer comprises a first sheet of flexible plastic material having said tactile protrusion formed therein; and wherein:

said striker element is part of a second sheet of flexible plastic material, said second sheet of flexible material having an aperture into which a coplanar projection extends, said coplanar projection having said recess formed therein.

4. A switch assembly as in claim 3 wherein:

said striker element coplanar projection is integrally hinged to said second sheet of flexible plastic material and can move relative to said second sheet of material.

5. A keyboard device including:

a first circuit layer having a plurality of first electrical conductors supported on at least one surface thereof, said first circuit layer defining a first plane;

a second circuit layer having a plurality of second electrical conductors supported on at least one surface thereof, said second circuit layer defining a second plane and being positioned relative to said first circuit layer so that said second conductors are aligned with and facing but normally out of contact with said first circuit conductors, said first and second planes being substantially parallel;

a plurality of tactile protrusions formed in said second circuit layer, each of said tactile protrusions being aligned with a first conductor and projecting away from said first circuit layer, said tactile protrusions each supporting at least a portion of one of said second conductors for selective contact with an aligned first conductor;

a plurality of keys spaced from said second circuit layer on the side thereof removed from said first circuit layer, each key being at least in part aligned with one of said tactile protrusions, said keys each having a movable actuator bar; and a striker layer positioned between said keys and said second circuit layer, said striker layer being provided with at least one aperture, said striker layer further having a plurality of striker elements extending partially into said aperture, said striker elements being generally coplanar with said striker layer, said striker elements being integrally hinged to said striker layer, said striker elements being positioned between a key and an aligned tactile protrusion, said striker elements each being provided with a recess extending away from the aligned keys, the key actuator bars being received in said recesses, said recesses having a geometrical configuration which will transfer an actuating force from said keys to the aligned tactile protrusion.

6. The keyboard device of claim 5 wherein:

said recesses of said striker elements are provided with flat base surfaces which are juxtapositioned to the tops of said tactile protrusions.

7. The keyboard device of claim 5 wherein:

said second circuitry layer is a sheet of flexible plastic material having said protrusion formed therein; and wherein:

said striker layer is a sheet of flexible plastic material having said striker elements formed therein.

8. A keyboard device as in claim 5 further including:

insulating means between said first and second circuit layers, said insulating means having a plurality of openings aligned with said protrusions to permit selective contact between aligned first and second circuit elements.

9. The keyboard device of claim 6 wherein:

said second circuitry layer is a sheet of flexible plastic material having said protrusion formed therein; and wherein:

said striker layer is a sheet of flexible plastic material having said striker elements formed therein.

10. A keyboard device as in claim 9 further including:

insulating means between said first and second circuit layers, said insulating means having a plurality of openings aligned with said protrusions to permit selective contact between aligned first and second circuit elements.

* * * * *